United States Patent [19]

Reyes

[11] Patent Number: 4,936,876

[45] Date of Patent: Jun. 26, 1990

[54] METHOD AND APPARATUS FOR DETECTING BACK CORONA IN AN ELECTROSTATIC FILTER WITH ORDINARY OR INTERMITTENT DC-VOLTAGE SUPPLY

[75] Inventor: Victor Reyes, Copenhagen, Denmark

[73] Assignee: F. L. Smidth & Co. A/S, Denmark

[21] Appl. No.: 119,553

[22] Filed: Nov. 12, 1987

[30] Foreign Application Priority Data

Nov. 19, 1986 [DK] Denmark ..... 5521/86

[51] Int. Cl.[5] ..... B03C 3/00

[52] U.S. Cl. ..... 55/2; 55/105

[58] Field of Search ..... 55/2, 105

[56] References Cited

U.S. PATENT DOCUMENTS

| | | | |
|---|---|---|---|
| 2,897,914 | 8/1959 | Camp et al. | 55/105 |
| 2,943,697 | 7/1960 | Little | 55/105 |
| 3,504,479 | 4/1970 | Coe, Jr. | 55/105 X |
| 3,873,282 | 3/1975 | Finch | 55/105 |
| 4,354,152 | 10/1982 | Herklotz et al. | 55/105 X |
| 4,382,805 | 5/1983 | Herklotz et al. | 55/2 |
| 4,410,849 | 10/1983 | Ando | 55/105 X |
| 4,432,061 | 2/1984 | Herklotz et al. | 55/105 X |
| 4,433,281 | 2/1984 | Herklotz et al. | 55/105 X |
| 4,680,036 | 7/1987 | Leussler | 55/2 |

FOREIGN PATENT DOCUMENTS

| | | | |
|---|---|---|---|
| 0184922 | 6/1986 | European Pat. Off. | 55/105 |

*Primary Examiner*—Bernard Nozick

*Attorney, Agent, or Firm*—Brumbaugh, Graves, Donohue & Raymond

[57] ABSTRACT

In an electrostatic precipitator for cleansing flue gases from industrial plants, comprising one or more precipitator sections powered from a separate continuous or intermittent DC-voltage electric supplies, a method and apparatus for detecting back corona, i.e. discharges in the dust layer precipitated on the collecting electrodes of an emission electrode system during the cleansing process, by making periodic upward adjustment of the precipitator current for each DC-voltage supply until spark-over occurs, and where after spark-over or a blocking of the precipitator current for a predetermined period of time if no spark-over occurs, the minimum value of the precipitator voltage is compared wtih the minimum value before the spark-over or before the blocking period, the latter minimum value being corrected by means of a predetermined sensitivity factor. In this way a measurement may be made for each single sparks-over so that the reducing effect of the spark-over on the degree of purification may be avoided at the next sparks-over.

5 Claims, 4 Drawing Sheets

METHOD AND APPARATUS FOR DETECTING BACK CORONA IN AN ELECTROSTATIC FILTER WITH ORDINARY OR INTERMITTENT DC-VOLTAGE SUPPLY

BACKGROUND OF THE INVENTION

The present invention relates to a method and apparatus for detecting the occurrence of back corona, i.e. electric discharges in the dust precipitated on the collecting electrodes of an emission electrode system of electrostatic precipitators which have one or more separate precipitator sections and which are used for purifying flue gases from industrial plants. In such precipitators the degree of purification increases proportionately with an increasing power input under operating conditions during which no back corona occurs. Where the dust layer on the emission system has a sufficiently high resistivity, a locally occurring overstepping of a current value characteristic of the type of dust and the current operating condition may, however, cause discharging in the dust layer with a resultant lowering of the degree of purification. It is, therefore, of essential importance to be able to immediately detect the occurrence of back corona in order to control the precipitator section for optimum cleansing of the flue gases.

U.S. Pat. No. 4,390,835 disclose a method for detecting back corona based on changes in the slope of the current-voltage characteristic curve. According to this patent, the mean current is utilized as a function of the mean value of the precipitator voltage. Similarly, according to U.S. Pat. No. 4,311,491, the mean current is utilized as a function of the minimum value of the precipitator voltage. According to Danish Patent Application no. 5118/86, detection is made by comparative measurement over a predetermined time interval of mean voltage, mean current and mean power fed to the subject precipitator section.

In recent years it has become common practice to utilize, in addition to the ordinary or continuous DC-voltage supply, a so-called intermittent voltage supply to increase detection efficiency. For example, according to U.S. Pat. No. 4,410,849, the power supply to the high voltage transformer is interrupted periodically for a specific number of half-periods of the main frequency, i.e. The frequency of the AC main supply line. Another method based on intermittent voltage supply is disclosed by German Published Patent Application no. DE 3525557 wherein a measurement is made over four consecutive half periods of the frequency of the main supply, after the power supply has been deliberately interrupted.

It is, therefore, an object of the present invention to provide a method and apparatus for reliable detection of the occurrence of back corona for precipitator sections operating with either continuous or intermittent DC-voltage supplies based on measuring the precipitator voltage before and after each spark-over.

SUMMARY OF THE INVENTION

According to the invention this is achieved by increasing the mean current in the precipitator section above a preset limit at selected intervals until spark-over occurs and detecting back corona by means of control equipment which, for each precipitator section, compares the minimum value of the precipitator voltage before and after a spark-over, or a blocking of the precipitator current for a predetermined period if no spark-over has occurred, subject to accurately controlled escalation of the precipitator voltage after the spark-over. The precipitator voltage is increased to a level equal to the mean voltage before the spark-over within a maximum of three half-periods of the main supply frequency regardless of the load on the DC-voltage supply.

At predetermined time intervals the DC-voltage supply goes through a detection procedure, during which the precipitator current is increased until a spark-over occurs, notwithstanding any overstepping of a preset limit. The minimum value of the precipitator voltage before spark-over ($U\text{-}_{Omin}$,) is compared with the minimum value after spark-over ($U_{2min}$), which, typically, corresponds to a selected one of a series of minimum values measured after the spark-over or any blocking of the precipitator current. Back corona is detected if $U_{2min}$ is a predetermined sensitivity factor k (e.g. k=1.05) greater than $U_{Omin}$. Conversely, back corona is not detected if $U_{2min}$ is smaller than or equal to k x $U_{Omin}$.

The minimum value after spark-over may be selected as the second or third minimum value measured after spark-over or as the average value of the second and third minimum values.

If the precipitator current has reached its limit of upward adjustment and there is no spark-over, the current is adjusted to a lower value (e.g. a current density of about 0.01 mA/m$^2$), and after a predetermined time interval the minimum value ($U_{emin}$) of the precipitator voltage is measured, and compared with the value before adjusting the current downwards ($U_{fmin}$). Back corona is detected if $U_{emin}$ is the predetermined sensitivity factor k greater than $O_{fmin}$.

The invention is based on the recognition that the back corona, which starts by discharges in the precipitated dust on the collecting plates which liberate ions of opposite polarity to that of ions generated by the discharge electrodes of the emission system and which cause the precipitator voltage to drop due to the increased conductivity of the gas in the electrode space, develops with a certain time constant. In the presence of spark-over the precipitator voltage drops to O V, causing the back corona to cease. Therefore, during the subsequent increase of voltage, the precipitator is able to briefly tolerate a higher voltage than before the spark-over, until back corona develops again.

Further features of the invention will be apparent from the following detailed description which makes reference to the accompanying drawings.

BRIEF DESCRIPTION OF THE DRAWINGS

FIG. 2(*b*) shows the minimum values without back corona;

FIG. 3(*b*) shows the minimum values without back corona;

FIG. 4(*b*) shows the minimum values without back corona.

DESCRIPTION OF THE PREFERRED EMBODIMENT

Figure 1:
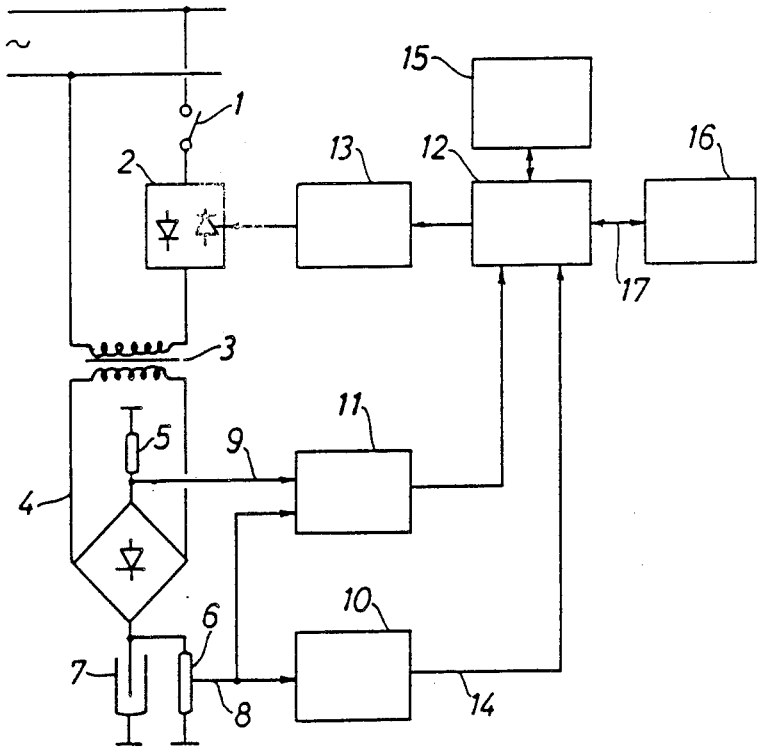
FIG. 1 shows in schematic form a precipitator section with associated DC-voltage supplies and control equipment.

In FIG. 1 the voltage of the main AC supply is conducted via a main contractor (1) to a thyristor phase control unit (2) and on to a high transformer (3) having a sufficiently high shorting voltage drop (typically 40 %). The high voltage coil of the transformer is connected via a rectifier circuit (4) to a precipitator section (7) and a voltage divider (6) and interposed current shunt resistor (5) for measuring the precipitator voltage and current. The signals from voltage divider (6) and current shunt (5) are conducted via the connectors (8) and (9) and interface circuits (11) to the control unit (12). The switch intervals of the thyristors (2) are computed in the control unit by a microprocessor based on measurements and the control strategy incorporated in the processor and are transmitted in digital form to the thyristors via gate amplifiers (13).

The signal from the voltage divider (6) is also conducted to a back corona detector (10). In the detector, shown as a separate unit, the minimum value of the precipitator voltage is compared before and after a spark-over or a downward adjustment of the precipitator current in the absence of a spark-over, and the occurrence of back corona is detected when the minimum value measured after spark-over is greater than the value measured before spark-over multiplied by a sensitivity factor K. A series of minimum values may be measured after spark-over and the minimum value used for comparison may be any one of the measured minimum values. Typically, the second minimum value $V_{2min}$ is chosen, and this is the value shown in FIGS. 2–4. It may also be the arithmetic mean of two consecutive values of the measured series. $U_{Omin}$ is preferably measured as one of the last three values before spark-over. Back corona is detected if $U_{2min}$ is greater than $U_{Omin}$ by a predetermined sensitivity factor K usually on the order of 1–1.05. The selection of sensitivity factor K is dependant on the particular process employing the precipitator and is usually chosen relative to the amount of back corona considered to be optimum.

Via the connection (14), the result is transmitted from the detector (10) to the control unit (12). The latter is connected to a control panel (15) having a keyboard and a display from which preset values, forming part of the control function, can be changed and read. The control unit (12) may be connected via connection (17) to a superior control unit (16) which transmits two-way information. The superior control unit may be common to a plurality of similar sections of the electrostatic precipitator and designed for simultaneous monitoring of the DC-voltage supplies of these sections. The control unit (12) and the back corona detector (10) may be digital, analog or a combination thereof. The detector (10) may either serve a single precipitator section or be common to a plurality of sections.

In case the control unit (12) cooperates with a superior control unit, the latter may be designed to monitor and control, wholly or in part, the detection procedure and to coordinate the detectors for each precipitator section to avoid certain undesirable conditions such as simultaneous blocking of the precipitator current in several power supplies.

Figure 2:
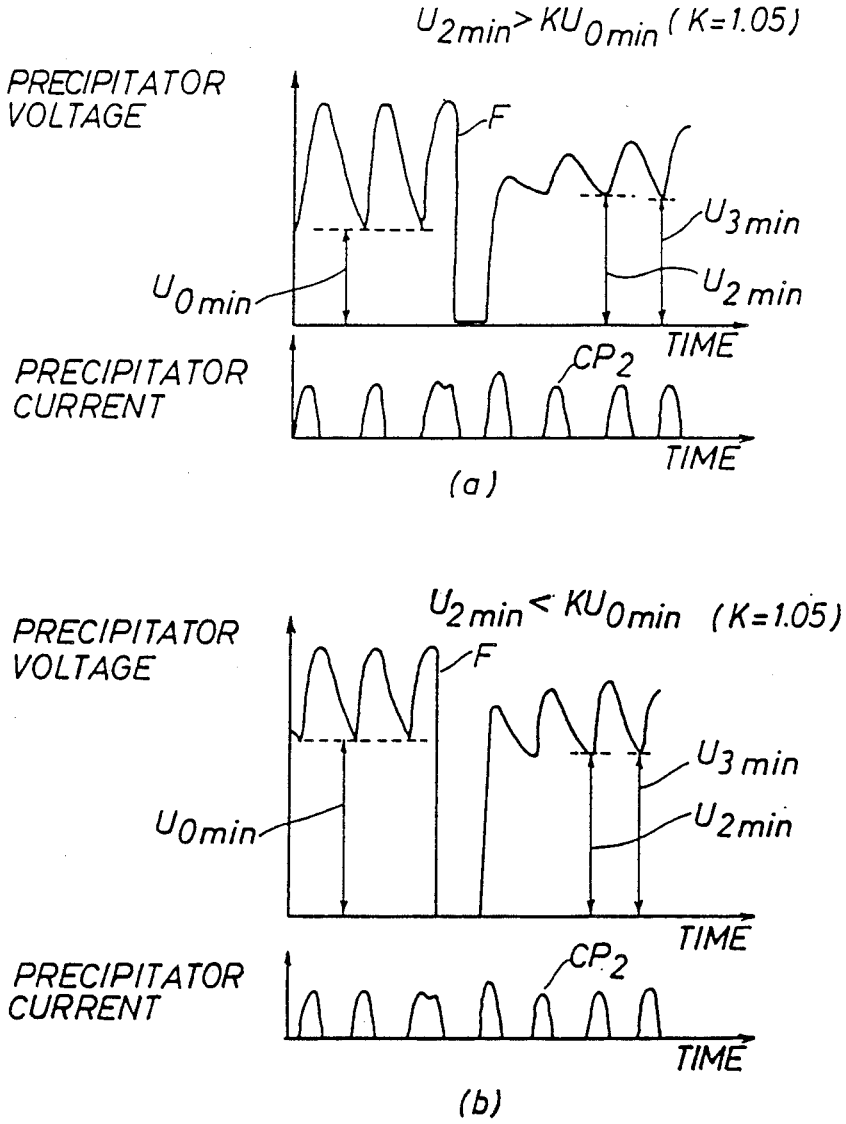
FIG. 2(*a*) shows minimum value of the precipitator voltage before and after spark-over in the presence of back corona as applied to a conventional voltage supply.

FIGS. 2(*a*) and (*b*) each illustrate a comparison of the minimum value before and after a spark-over F where a conventional voltage supply is used. The value before spark-over is designated $U_{Omin}$ and after spark-over $U_{2min}$, corresponding to the second minimum value measured after spark-over, i.e. The value to which the precipitated voltage drops after the second pulse of the precipitated current and just before initiation of the third current pulse. FIG. 2*a* shows the position in the presence of back corona, and FIG. 2*b* the position in the absence of back corona with indication of the difference in magnitude between $U_{2min}$ and $U_{Omin}$. The ordinate indicates the precipitator voltage $U_F$ measured in kV and the abscissa indicates the time t.

Figure 3:
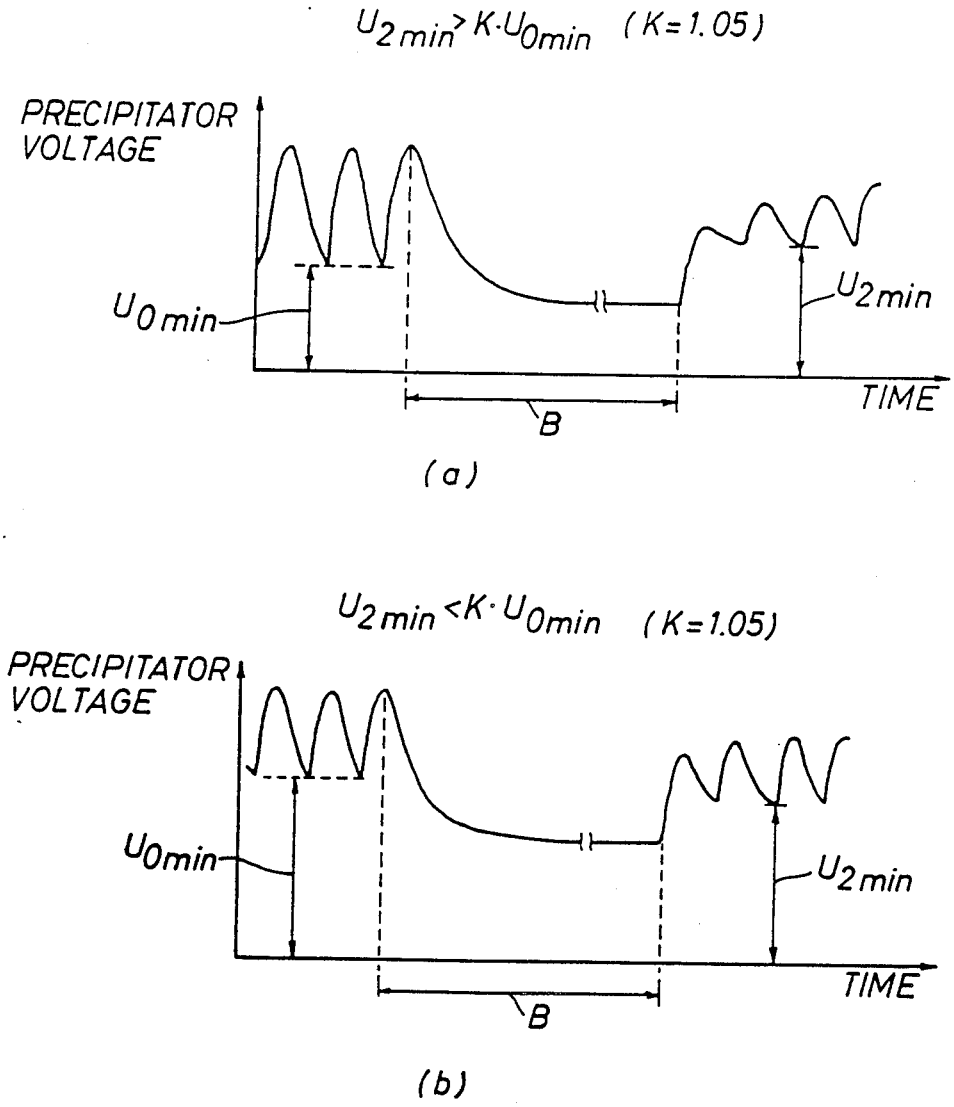
FIG. 3(*a*) shows the minimum value of the precipitator voltage before and after upward and downward adjustment of the precipitator current in the presence of back corona as applied to a conventional voltage supply.

FIGS. 3(*a*) and (*b*) each show the precipitator voltage before and after downward adjustment of the precipitator current in the case where a conventional voltage supply is used. $U_{fmin}$ is the voltage before downward adjustment and $U_{emin}$ the voltage after downward adjustment. FIG. 3*a* shows a situation with back corona, while FIG. 3*b* shows a situation without back corona.

Figure 4:
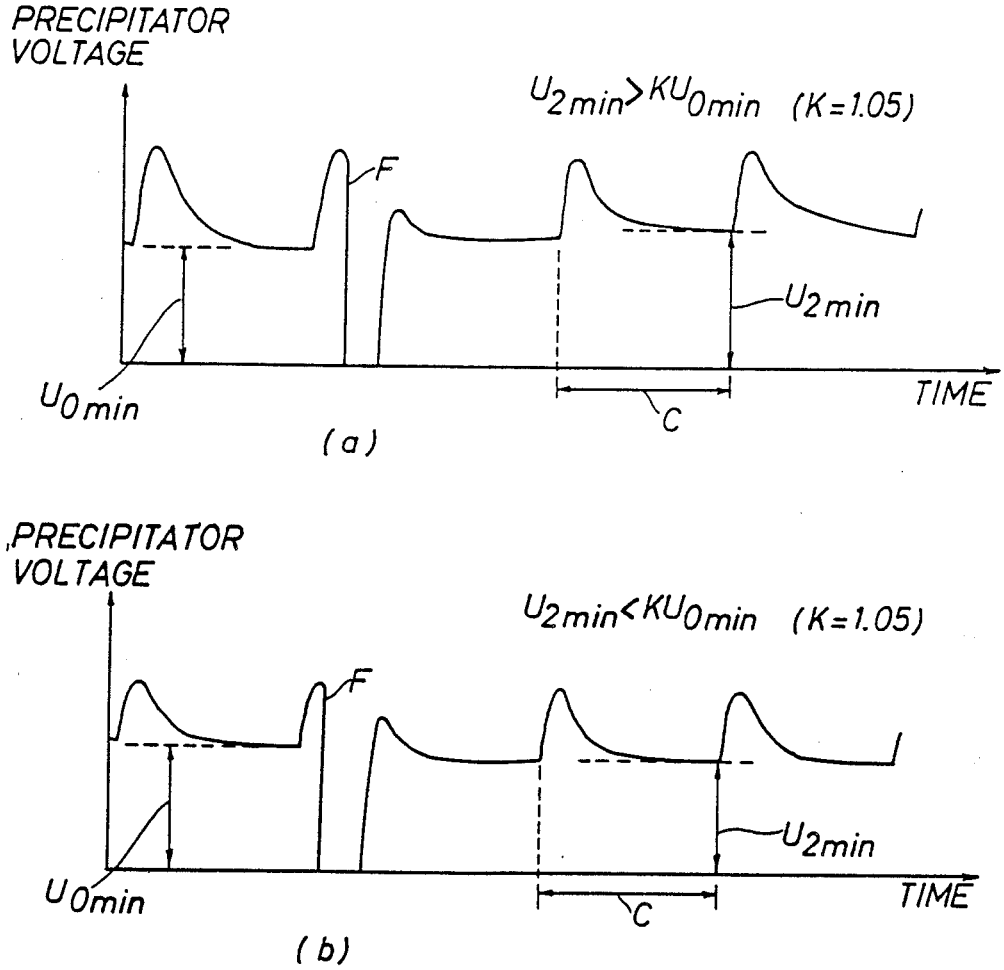
FIG. 4(*a*) shows the precipitator voltage before and after spark-over with back corona, as applied to an intermittent voltage supply.

FIGS. 4(*a*) and (*b*) represent a comparison of the minimum value before and after a spark-over F in the case where an intermittent voltage supply is employed. Cycle period (C) corresponds to three half-periods of the frequency of the main AC supply line. The thyristors are blocked for two half-periods after a detecting interval of one half-period. The other designations are the same as those indicated in FIG. 2. FIG. 4*a* shows the precipitator voltage at spark-over in the presence of back corona, while FIG. 4*b* shows the position without back corona.

The detailed description of the preferred embodiment having been set forth, it will be appreciated by those skilled in the art that there may be modifications or changes therein without departing from the spirit and nature of the invention claim hereinbelow.

I claim:

1. A method for defining back corona occurrences in a dust layer precipitated on an electrostatic precipitator used in the process of cleansing flue gases from industrial plants wherein said precipitator has a section powered by a precipitator voltage and current from a DC voltage supply, said method comprising the steps of making a periodic upward adjustment of the precipitator current for the DC-voltage supply until spark-over is induced in the precipitator or until a predetermined upper limit of adjustment is reached without spark-over being induced;

recording the precipitator voltage as a function of time;

if the predetermined upper limit of adjustment is reached before spark-over is induced, thence blocking the precipitator current for a predetermined period of time;

measuring a series of minimum values, i.e. trough values, of the precipitator voltage before and after spark-over or before and after said blocking period, as the case may be;

comparing the minimum values measured before and after spark-over or before and after said blocking period in selecting the minimum value of the precipitator voltage after spark-over or after said blocking period as the second minimum value, the third minimum value or the arithmetic mean value of these two values;

defining a back corona if the minimum value of the precipitator voltage after spark-over or said blocking period is a predetermined sensitivity factor greater than the measured minimum value of the filter voltage before spark-over or said blocking period; and adjusting the precipitator current downwardly when conditions defining back corona have been met.

2. The method according to claim 1 wherein the DC-voltage supply is a continuous DC supply.

3. The method according to claim 1 wherein the DC-voltage supply is an intermittent DC supply.

4. The method according to claim 1 further comprising the steps of creating a signal indicative of the defined occurrence of back corona; and transmitting said signal to indication means for indicating a defined occurrence of back corona.

5. A method according to claim 1 wherein said predetermined sensitivity factor is in the range of 1–1.5.

* * * * *